US006390348B1

(12) United States Patent
Godshaw et al.

(10) Patent No.: US 6,390,348 B1
(45) **Date of Patent: *May 21, 2002**

(54) TOOL BELT

(75) Inventors: Donald E Godshaw, Evanson; Andrzej M. Redzisz, Skokie, both of IL (US)

(73) Assignee: Travel Caddy, Inc., Des Plaines, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/359,339

(22) Filed: Jul. 21, 1999

(51) Int. Cl.[7] ..... A45E 1/04

(52) U.S. Cl. ..... 224/674; 224/660; 224/662; 224/684; 224/904; 224/907

(58) Field of Search ..... 224/224, 234, 224/240, 252, 253, 254, 255, 582, 583, 674, 904, 660, 665, 911, 662, 684, 907

(56) References Cited

U.S. PATENT DOCUMENTS 4,269,179 A * 5/1981 Burton et al. ..... 602/36
4,422,452 A * 12/1983 Burton ..... 602/36
4,747,527 A * 5/1988 Trumpower, II ..... 224/224
4,782,535 A * 11/1988 Yewer, Jr. et al. ..... 2/321
D302,489 S * 8/1989 Stones et al. ..... D2/630
4,923,105 A * 5/1990 Snyder ..... 224/255
5,386,932 A * 2/1995 Gross ..... 224/907 X
5,388,274 A * 2/1995 Glover et al. ..... 2/338
5,413,262 A * 5/1995 Dewire et al. ..... 224/675
5,497,923 A * 3/1996 Pearson et al. ..... 224/253
5,548,843 A * 8/1996 Chase et al. ..... 2/102
5,586,969 A * 12/1996 Yewer, Jr. et al. ..... 602/19
5,651,763 A * 7/1997 Gates ..... 602/19
5,673,830 A * 10/1997 Matthews ..... 224/268
5,683,022 A * 11/1997 Evans ..... 224/583
5,776,087 A * 7/1998 Nelson et al. ..... 602/19
5,988,315 A * 11/1999 Crane ..... 182/3

* cited by examiner

*Primary Examiner*—Lee Young
*Assistant Examiner*—Joseph C. Merek
(74) *Attorney, Agent, or Firm*—Banner & Witcoff, Ltd.

(57) ABSTRACT

A tool belt comprises an inside girdle with a strap fitted through loops on the outside surface of the girdle to retain a series of tool pockets attached to the strap by means of nooses on the upper end of each of the pockets enabling easy adjustment and replacement of the pockets. The girdle is shaped to provide for maximum comfort and support of the user.

5 Claims, 5 Drawing Sheets

TOOL BELT

BACKGROUND OF THE INVENTION

This invention relates to a tool belt, and more particularly, to a tool belt of the type which includes a number of adjustable pocket and tool support members.

Construction workers, tradesmen and the like typically use a tool belt attached about their waist to transport to and maintain tools at a worksite. Such belts often are fabricated from leather and may include a number of pockets which designed to hold tools such as pliers, screwdrivers, and the like. Desirable characteristics for such belts are durability and the capability to hold and store many tools. The belts also must be comfortable and yet durable, in order to withstand rugged circumstances. Additionally, the belt must be designed to accommodate various types of tools, and if possible, permit alteration and adjustment in order to accommodate various types of tools, various sizes of girth and other circumstances which may be encountered in the field. Thus, there has remained a need for an improved, yet aesthetic, tool belt which is comfortable to wear, rugged, economical and easily adaptable for multiple situations.

SUMMARY OF THE INVENTION

Briefly, the present invention comprises a tool belt which includes an elongate girdle having a unique configuration. The girdle includes a series of loops on the outside surface which are adapted to receive a strap therethrough. The ends of the strap may then be buckled to close the girdle and maintain the tool belt on an individual. Pockets and tool holders of various size, configuration and construction are suspended on the strap which passes through the loops attached to the girdle. The pockets as well as the girdle are typically fabricated from a fabric material whereas the strap may be fabricated from fabric, or preferably, a leather material. The pockets include unique outside stitching which cause the pockets to remain open for accessibility when suspended on the strap attached to the girdle. A unique and special construction for a tool holder designed to retain a hammer or similar tool is also disclosed.

Thus, it is an object of the invention to provide an improved tool belt construction.

A further object of the invention is to provide a tool belt construction which is rugged, economical, easily adjusted to accommodate various girths and various combinations of tools and implements.

Another object of the invention is to provide an improved tool belt construction which includes a girdle that may incorporate additional cushioning material and which is shaped to provide additional physical support to the user.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

Figure 1:
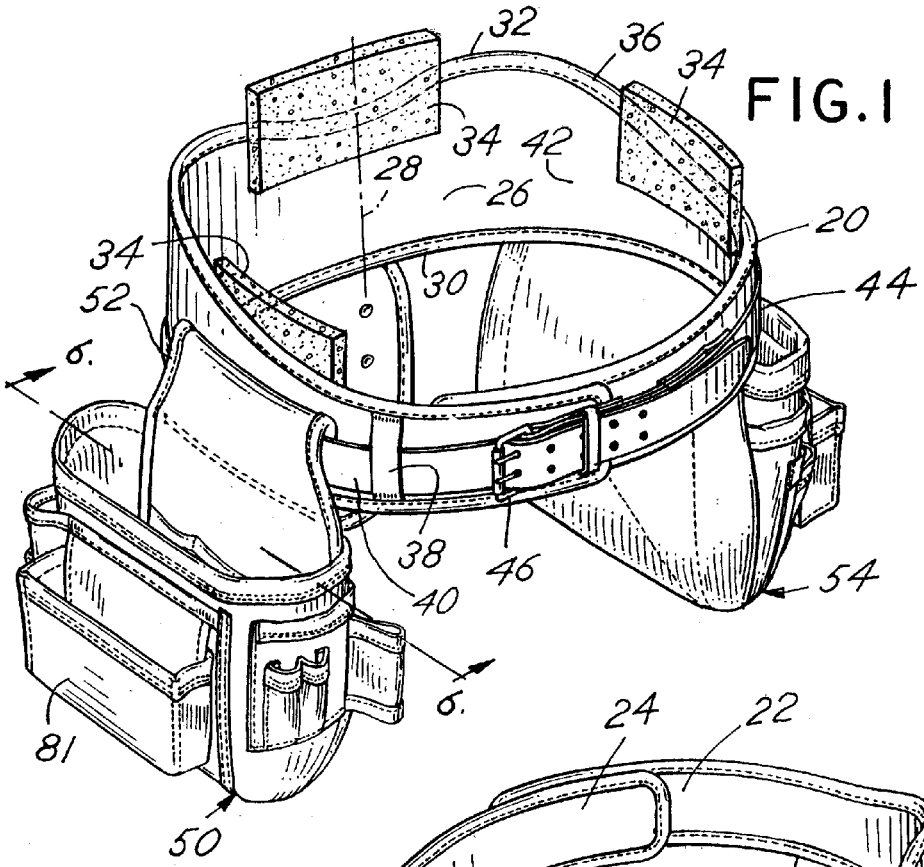
FIG. 1 is a front isometric view of a preferred embodiment of the tool belt of the invention.
Figure 2:
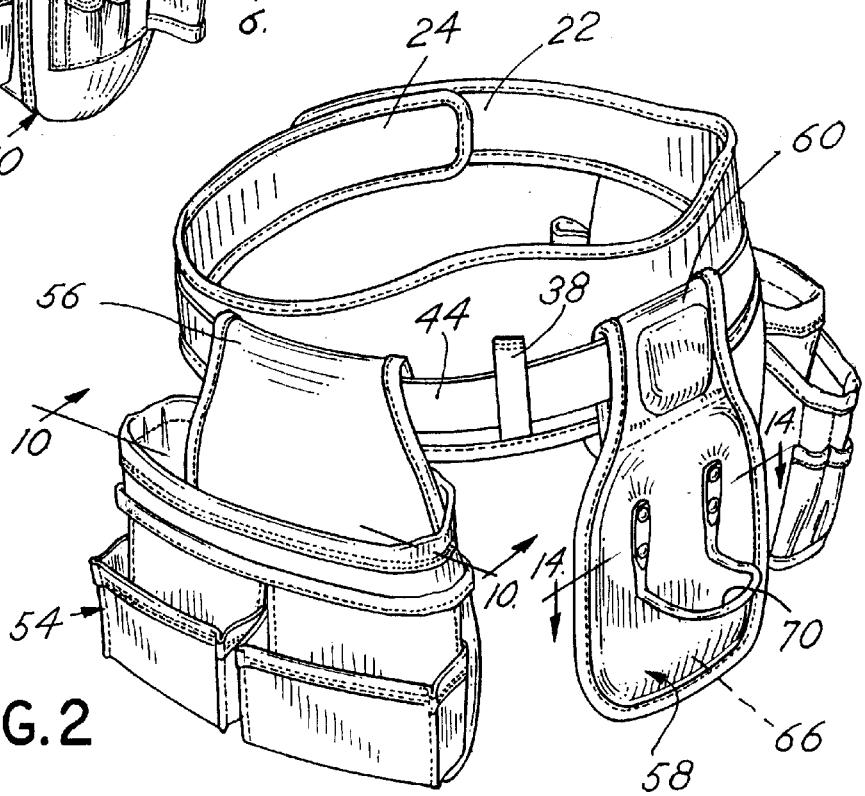
FIG. 2 is a back isometric view of the tool belt of FIG. 1.
Figure 3:
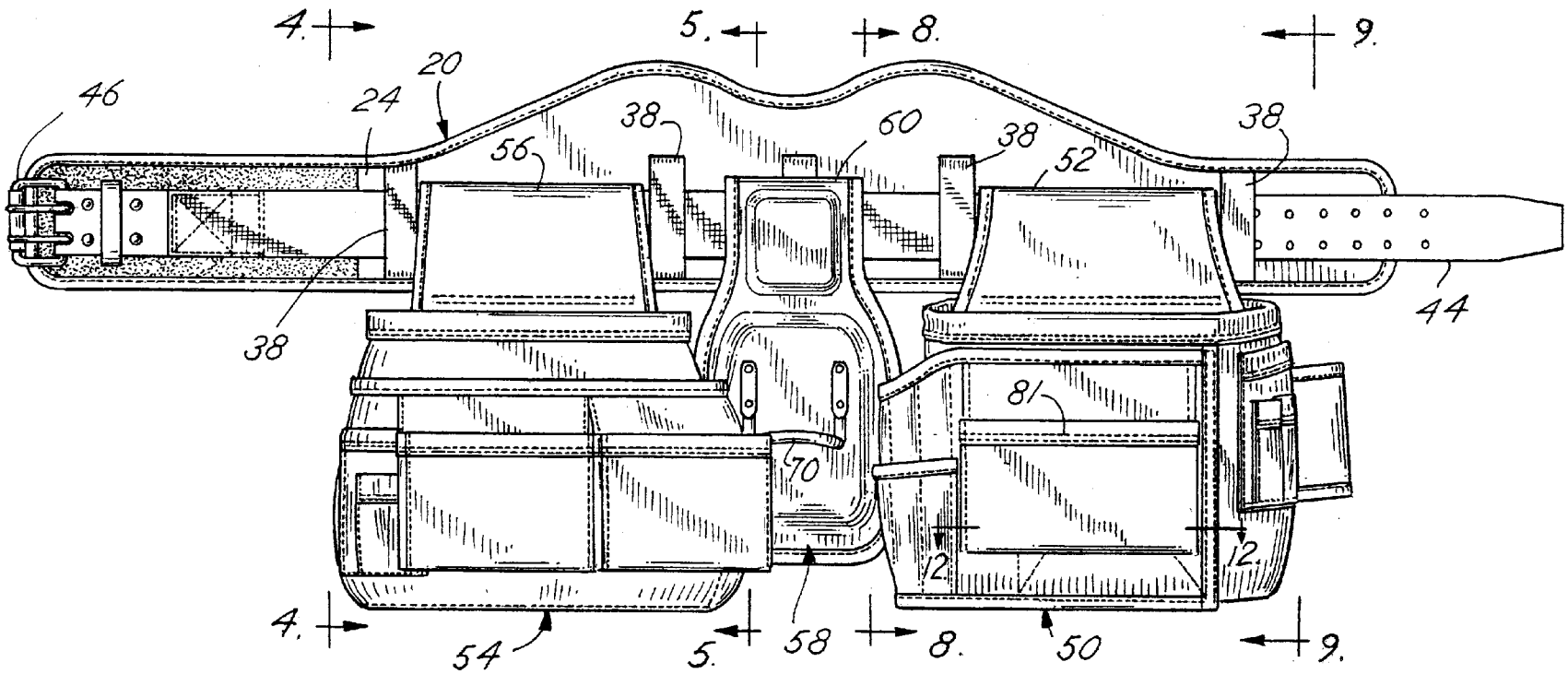
FIG. 3 is an outside plan view of the tool belt of FIG. 1.
Figure 4:
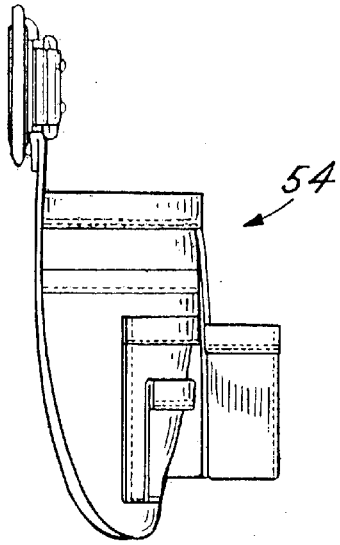
FIG. 4 is a cross sectional view taken along the line 4—4 in FIG. 3.
Figure 5:
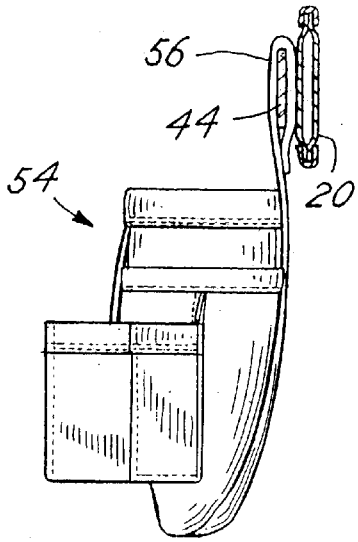
FIG. 5 is a cross sectional view taken along the line 5—5 in FIG. 3.

Referring to the figures, the belt of the invention comprises a girdle 20 which has a first outer end 22 and a second outer end 24. When in use, the ends 22, 24 overlap. The girdle 20 further includes a central section 26 and a transverse center line axis 28, which defines substantially the midpoint of the girdle 20. The girdle 20 includes a lateral or height dimension from a bottom edge 30 to a top edge 32 which varies about the circumference or linear run of the girdle 20. The lateral dimension at the center line or central axis 28 is greater than the lateral dimension of the ends 22, 24. The lateral dimension of the girdle 20 on the opposite sides 27, 29 of the central axis 28 is greater than the lateral dimension at the central axis 28. The lateral dimension of sides 27, 29 32 is chosen to provide additional support to the backside of a person wearing the belt on each side of the spine of a person. The girdle 20 may further include supplemental cushioning members, such as a soft sponge rubber block 34, positioned at strategic points about the circumference of the girdle 20. The use of the cushioning block or material 34 is, of course, optional.

Typically, the girdle 20 is formed from a rugged fabric material which is formed in dual, over laying layers with an edging 36 stitched to connect the dual layers of fabric. Thus, edging 36 is stitched about the outside perimeter or periphery of girdle 20, and girdle 20 is formed by a dual layer of rugged fabric material.

Integrally sewn onto the outside surface of the girdle 20 are a series of spaced, open loops 38 for receipt of a strap 44. The loops 38 are strategically placed about the outside surface 40. Preferably, the loops 38 are positioned so that pockets (to be described below) which include a pocket noose, will be supported between loops 38. An inside surface 42 of girdle 20 is generally a smooth surface which, except for the cushioning blocks 34, provides a comfortable surface to fit against the body of a user.

Strap 44 is fitted against the outside surface 40 of the girdle 20 and extends through the loops 38. The strap 44 is preferably a rugged material, such as leather, and includes a buckle 46 for connecting the opposite ends of the strap 44 to retain the belt about a user. The buckle 46 is, of course, adjustable and includes multiple openings to permit adjustment and to hold the overlapping, opposite ends 22, 24 of the girdle 20. The strap 44 thus fits through the loops 38 and further through nooses associated with pockets as described below. The strap 44 has a relatively narrower lateral height as contrasted to the girdle 20. The strap 44 is retained in a generally slidable position relative to the girdle 20 by the loops 38. It is to be noted that because the strap 44 and girdle 20 are separate components, they may be substituted, replaced, interchanged and the like. Thus, a belt may comprise a strap 44 and a girdle 20 may be custom chosen by a particular user to accommodate the users physique in terms of the correct size and length of girdle 20 and belt 44.

Figure 14:
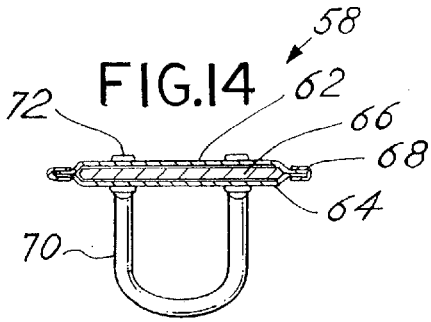
FIG. 14 is a sectional view taken along the line 14—14 in FIG. 2.

Typically, a plurality of pockets, such as depicted in the figures, are supported on the strap 44. Thus, by way of example, a pocket 50 which includes a fabric noose 52 is fitted onto the strap 44. Another pocket 54 which includes a noose 56 is also fitted on the strap 44. A tool holder 58 which includes a noose 60 is also fitted on the strap 44. Also, typically, a loop 38 is provided on each side of a noose 52 to enhance support and balance of pockets. The tool holder 58 is comprised of an inside layer of fabric 62 as shown in FIG. 14, an outside layer of fabric 64, a center stiffening board 66 and circumferential edging 68 which is sewn to encapsulate the board 66 and connect the fabric layers 62 and 64. A tool holder member, such as a circular loop metal ring 70, is attached by means of rivets or fasteners 72 through the board 66 and the fabric layers 62 and 64. A ring 70 of the type depicted in the figures typically may receive the handle of a hammer and support the hammer head, for example. The board 66 extends over the planar area of holder 58, but not into the noose 60. The noose 60 merely is formed by extensions of the fabric 62 and 64 to form the noose 60 which then receives the strap 44.

Figure 6:
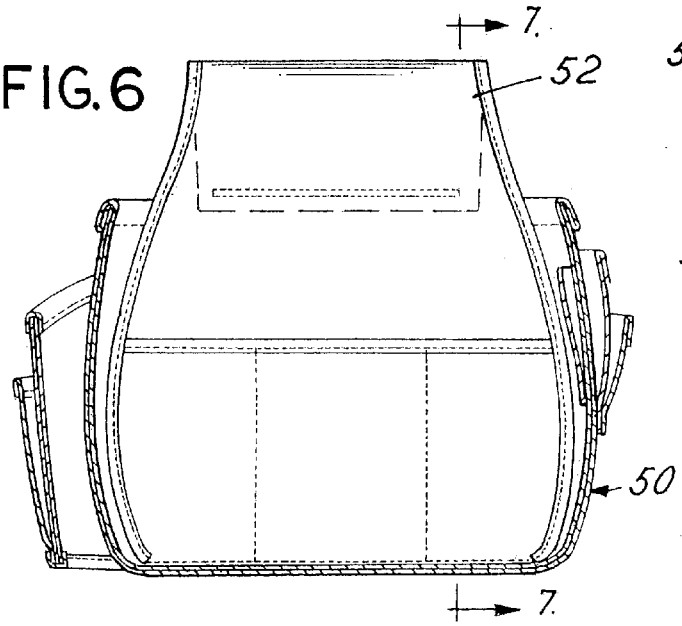
FIG. 6 is a sectional view taken along the line 6—6 in FIG. 1.
Figure 7:
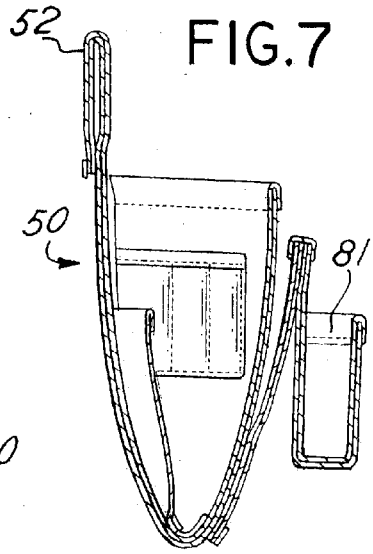
FIG. 7 is a sectional view taken along the line 7—7 in FIG. 6.
Figure 8:
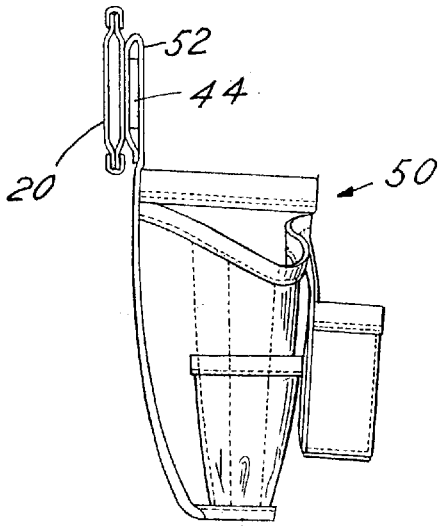
FIG. 8 is a sectional view taken along the line 8—8 in FIG. 3.
Figure 9:
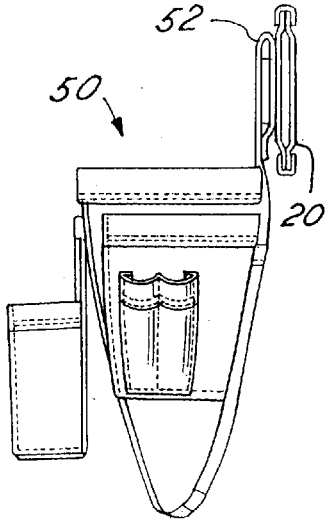
FIG. 9 is a sectional view taken along the line 9—9 in FIG. 3.
Figure 12:
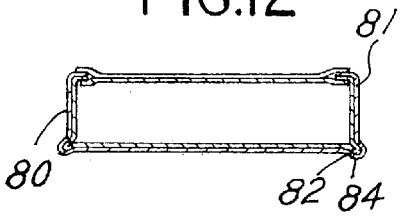
FIG. 12 is a sectional view taken along the line 12—12 in FIG. 3.
Figure 10:
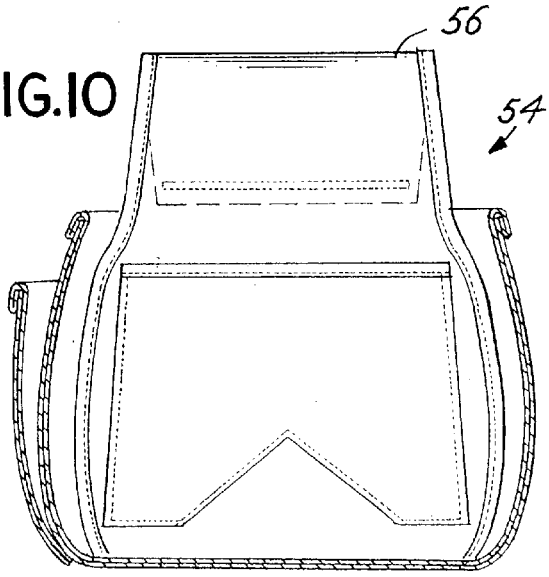
FIG. 10 is a sectional view taken along the line 10—10 in FIG. 2.
Figure 11:
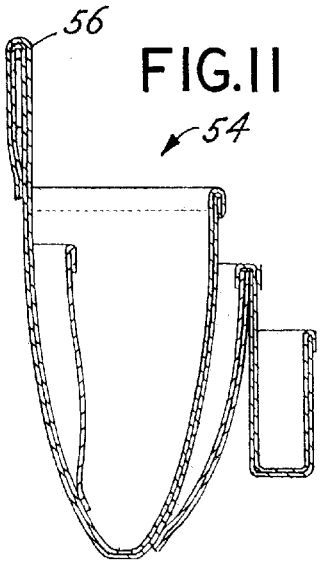
FIG. 11 is a sectional view taken along the line 11—11 in FIG. 10.

Pocket 50 is designed as one of many possibilities for pocket designs. Layers of fabric, such as shown in FIG. 6, are sewn to form a noose 52 as well as a series of storage pockets 81 for various items. Certain pockets are made by means of a special sewing technique to maintain the pocket 50 in the open condition when supported on the strap 44. This is depicted in FIG. 12. There it is shown that layers of fabric 80 are formed or folded to form a pocket 50. The comers 83 of the pocket 50 in FIG. 12 are sewn by a technique termed out stitching, or outside stitching. That is, a stitch 82 is formed through a fold 84 at the comer of the formed fabric or pocket 50. In this manner, the pocket 50 remains open so that a worker or user may easily place items in the pocket 50 such as small tools, fasteners, etc.

Figure 13:
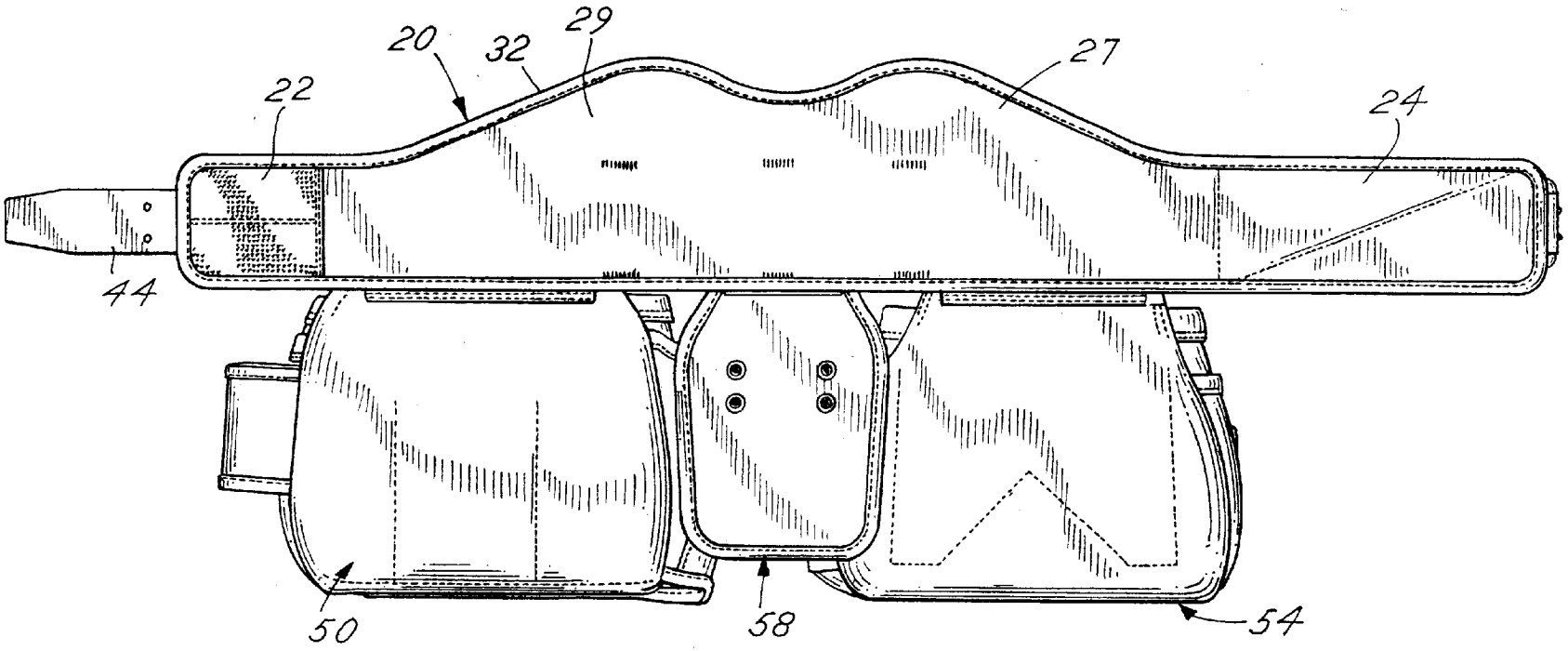
FIG. 13 is a backside view of the belt of FIG. 3.

It is noted that the arrangement and number of pockets may be altered or changed in accord with the desires of the user. Pockets which are damaged or need to be replaced can easily be replaced with the combination described inasmuch as the strap 44 can be removed and then reinserted through a noose associated with a new pocket. The number of pockets may be altered according to need and desire. The arrangement or sequence of the pockets may also be altered according to need or desires. As shown in FIG. 13, the backside of the pockets and attachments held in position by the strap 44 are generally smooth so as to provide for comfort by the user. Various other alternative pocket constructions and combinations may thus be utilized. The invention is therefore limited only by the following claims and equivalents thereof.

What is claimed is:

1. A tool belt comprising, in combination:

(a) an elongate girdle having an inside surface, an outside surface, opposite ends and a connecting central section, said girdle having a bottom edge and a top edge separated by a lateral height dimension, said central section having a lateral, height dimension greater than the lateral height dimension of the opposite ends, said central section configured to fit against the backside of a person, the opposite ends configured to fit over the front side of a person and overlap each other, the central section further including a mid line, vertical axis with a lateral height dimension between the edges as measured from the bottom edge, said midline axis dimension being less than the lateral height dimension of the central section on either side of the mid line axis and greater than the lateral height dimension of the opposite ends to thereby protect the spine at the midline axis and the region on opposite sides of the spine of a person by means of the girdle on each side of the midline axis, said midline axis being positionable over the spine of an individual, said central section at the midline axis having a lesser height dimension and defining a smoothly variable curve on opposite sides of the midline axis between a minimum at the midline axis to a maximum on opposite sides of the midline axis, said bottom edge being a substantially straight line edge, said girdle further including a plurality of loops on the outside surface thereof for receipt of a strap;

(b) a removable slidable, single belt strap fitted through the loops on the outside surface of the girdle and including strap ends connectable to each other to thereby retain the strap and girdle on a person with the mid line axis aligned on the spine of the backside of a person; and (c) a plurality of tool pocket members mounted on the strap, each pocket member mounted between two loops, each pocket member including a single slidable noose section through which the strap is fitted and a depending tool holding section, each pocket member including a loop on the opposite sides thereof, said noose slidable on the strap between the two loops.

2. The belt of claim 1 wherein a pocket member comprises a fabric covered board member with a hook attached to the fabric covered board member for holding a tool, said fabric extending from an end of the board and formed into a noose section.

3. The belt of claim 1 wherein a pocket member comprises a fabric pocket with one side of the fabric pocket extending from the pocket to form a noose.

4. The belt of claim 3 further including a pocket formed, at least in part, by outside stitching on a portion of the fabric.

5. The belt of claim 1 further including a padding member on the inside surface of the girdle central section.

* * * * *